US009492727B2

(12) United States Patent
Brossman

(10) Patent No.: US 9,492,727 B2
(45) Date of Patent: Nov. 15, 2016

(54) TEE-BALL APPARATUS

(71) Applicant: Aaron Brossman, Reading, PA (US)

(72) Inventor: Aaron Brossman, Reading, PA (US)

( * ) Notice: Subject to any disclaimer, the term of this patent is extended or adjusted under 35 U.S.C. 154(b) by 0 days.

(21) Appl. No.: 14/886,159

(22) Filed: Oct. 19, 2015

(65) Prior Publication Data

US 2016/0107059 A1 Apr. 21, 2016

Related U.S. Application Data

(60) Provisional application No. 62/066,732, filed on Oct. 21, 2014.

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2102/18* (2015.10); *A63B 2208/12* (2013.01); *A63B 2225/09* (2013.01); *A63B 2225/093* (2013.01)

(58) Field of Classification Search
CPC ..... A63B 69/0002; A63B 69/0075; A63B 2069/0008; A63B 2208/12; A63B 2210/50; A63B 69/3667; A63B 2069/0006; A63B 69/0057
USPC ..... 473/452, 417, 451, 422, 423–429, 273, 473/702; D21/662, 780, 698
See application file for complete search history.

(56) References Cited

U.S. PATENT DOCUMENTS 2,941,808 A * 6/1960 Smith ..... A63B 69/3667 473/273
3,244,421 A * 4/1966 Hanna ..... A63B 69/3667 434/252
3,300,219 A * 1/1967 Sipos ..... A63B 69/3667 473/218
4,664,375 A * 5/1987 Tetreault ..... A63B 69/0079 473/429
5,076,580 A * 12/1991 Lang ..... A63B 69/0002 473/417
5,435,572 A * 7/1995 Covel ..... A63B 69/0091 473/423
5,536,004 A * 7/1996 Wiseman ..... A63B 69/0002 473/417
5,540,430 A * 7/1996 Nichols ..... A63B 69/0002 473/417
D399,280 S * 10/1998 Griffin ..... D21/753
5,947,833 A * 9/1999 Alward ..... A63B 69/0002 473/452
6,102,818 A * 8/2000 Hamilton ..... A63B 69/0002 473/452
7,090,599 B2 * 8/2006 Hedgepath ..... A63B 69/0002 473/452
D602,553 S * 10/2009 Wright ..... D21/780
D714,406 S * 9/2014 Saruma ..... D21/698
2006/0142099 A1 * 6/2006 Trucks ..... A63B 69/0002 473/452
2006/0211522 A1 * 9/2006 Hapanowicz ..... A63B 69/0002 473/452
2006/0234816 A1 * 10/2006 Reason-Kerkhoff A63B 69/0002 473/452
2011/0003652 A1 * 1/2011 Brend ..... A63B 69/00 473/452
2015/0265895 A1 * 9/2015 Goodgame ..... A63B 69/0002 473/452
2016/0107059 A1 * 4/2016 Brossman ..... A63B 69/0075 473/417

* cited by examiner

*Primary Examiner* — Mitra Aryanpour
(74) *Attorney, Agent, or Firm* — Steve O'Donnell

(57) ABSTRACT

A tee-ball apparatus having two foot pads which can be adjusted for each batter is disclosed. Once adjusted, the foot pads are not displaced by normal batter actions but can be quickly readjusted for other batters when needed. The tee-ball apparatus can be used with either leftie or rightie batters. The post may be displaced by an errant swing and returned to its normal upright position. The post may also be removable from the rest of the apparatus to allow the batter to practice swinging at pitches while still utilizing the foot pads to maintain proper stance.

3 Claims, 7 Drawing Sheets

TEE-BALL APPARATUS

FIELD OF THE INVENTION

The instant invention relates to a system and method for facilitating instructing a tee-ball hitter on where to stand when batting. The system is useful for instructing users of all ages and is particularly useful for coaching young children who play on a tee-ball team.

BACKGROUND

Tee-ball is a sport well known in the art and is similar to baseball, except the ball is placed on a tee before the hitter swings a bat at the ball. Tee-ball is typically a sport that introduces young players to the concepts of baseball. Players must learn the fundamentals of how to play baseball and tee-ball, including where to place their feet in their batting stance.

Young children, particularly those who are new to the sport of tee-ball, often require repeated instructions on where to stand when batting. For example, these children need to be reminded which side of the tee to stand on, how far away from the tee they should stand, how far apart their feet should be, and where each foot should be in relation to the tee. While a hitter's box can be useful for older players of baseball, young players of tee-ball often require clearer, more narrowly defined instructions.

On tee-ball teams with young players, a tee-ball coach frequently struggles with teaching the players where to stand to hit the ball off the tee. Some players may fall after each swing, and, therefore, may require directions on where to place their feet before each swing. Thus, a coach must be standing nearby so the coach can quickly assist the hitter in placing the hitter's feet in proper spatial relation with respect to home plate.

While a batter's box outlined in chalk or tape provides a rough guideline of where a player should stand, it does not indicate where a hitter should place each foot when batting. The coach may mark ideal foot placement with tape or chalk, but would need to re-mark between player's turns at bat because players have different stances. Such marking can be a difficult and wasteful process.

SUMMARY

The present invention provides an easily adjustable system for guiding or instructing a hitter on where to place his or her feet when batting in a tee-ball game or practice. The present invention also provides a method of using the tee-ball system. The present invention is particularly useful for instructing young children where to stand without a needing a parent or coach to intervene after each swing.

The present invention provides a base (which can serve as home plate) to which durable foot location mats are pivotably and slidably attached, and from which a tee-ball post extends. The foot location mats provide easily identifiable targets for foot placement when a hitter is placing his or her feet near the tee. The foot mats can be adjusted for hitters based on the hitter's arm and leg length. After the coach positions the mats at locations corresponding to a specific hitter's stance, the hitter simply approaches the tee and places his or her feet on the mats. Before each subsequent swing the hitter replaces his feet on the mats if his feet moved off the mats after the previous swing.

In the preferred embodiment of the present invention disclosed herein, the tee-ball system has a base from which a post extends upwardly for supporting a ball. The post is preferably flexibly secured to the base so that it can pivot or deflect with respect to the base if the hitter strikes the post. The post may also be removable from the base so that a hitter can practice swinging at a pitched ball rather than at a stationary ball.

A pair of foot location mats provides easily identifiable targets on which a hitter is instructed to place his or her feet. During normal use, a coach only needs to adjust the position of these mats once before a hitter's turn at bat, and the coach then instructs the hitter to place his feet on the mats before each swing. The coach can simply yell out this verbal instruction so the coach does not have to be near the tee during the entire turn at bat.

The foot location mats are preferably comprised of a flexible material such as rubber, so they can more easily follow the surface profile of the ground underneath the mat when a user stands on the mat.

To allow easy, repeatable positioning of the mats, the front and back foot mats are secured to ends of respective front and back telescoping rods which extend transversely from the base. The rods are pivotable with respect to the base so the mats can be used by a left-handed hitter or a right-handed hitter. The rods are preferably secured to the base by hinges. At least one of the rods is slidable parallel to the base's longitudinal axis, allowing a user to adjust the width of the mats to correspond to a hitter's batting stance. The rods are preferably telescoping in the transverse direction with respect to the base so the coach can easily adjust the distance of the mats from the base can for each hitter.

Because the foot location mats are easily adjusted because of the hinged, telescoping, and slidable rods, they provide customizable foot location targets for a hitter.

The present invention is particularly useful after the hitter takes a big swing in which the hitter loses his or her footing or falls to the ground.

When the hitter reaches some level of mastery of tee-ball, the coach may remove the post from the base for practicing hitting a pitched ball instead of a stationary ball. The coach may replace the post if the hitter is not quite ready to hit a pitched ball or as needed for another hitter.

Thus, the tee-ball system of the present invention provides a useful training device teaching children to stand in the correct location for a turn at bat.

Proper foot placement helps the hitter swing the bat correctly. Over repeated use, the hitter will learn proper foot placement through habit, and will be much better prepared for tee-ball, as well as for baseball or softball when they reach the age to sign up. The subject matter of this application is particularly useful for coaching children aged 4, 5, and 6 years old. However, the system may be useful for hitters of any age or skill level.

Accordingly, among the objects of the instant invention are: to provide a tee-ball apparatus which encourages a hitter to use a proper stance; to provide a tee-ball apparatus useful for instructing users of various sizes on proper batting stance; providing a tee-ball apparatus comprising flexible foot location mats; providing a reusable, portable, and easily adjusted tee-ball apparatus that encourages a hitter to use a proper batting stance.

Other objects, features and advantages of the invention shall become apparent as the description thereof proceeds when considered in connection with the accompanying illustrative drawings.

DETAILED DESCRIPTION OF THE DRAWINGS

The following description and referenced drawings illustrate embodiments of the application's subject matter. They are not intended to limit the scope. Those familiar with the art will recognize that other embodiments of the disclosed method are possible. All such alternative embodiments should be considered within the scope of the application's claims.

Each reference number consists of three digits. The first digit corresponds to the number of the figure in which that reference number is first shown. Reference numbers are not necessarily discussed in the order of their appearance in the figures.

Figure 1:
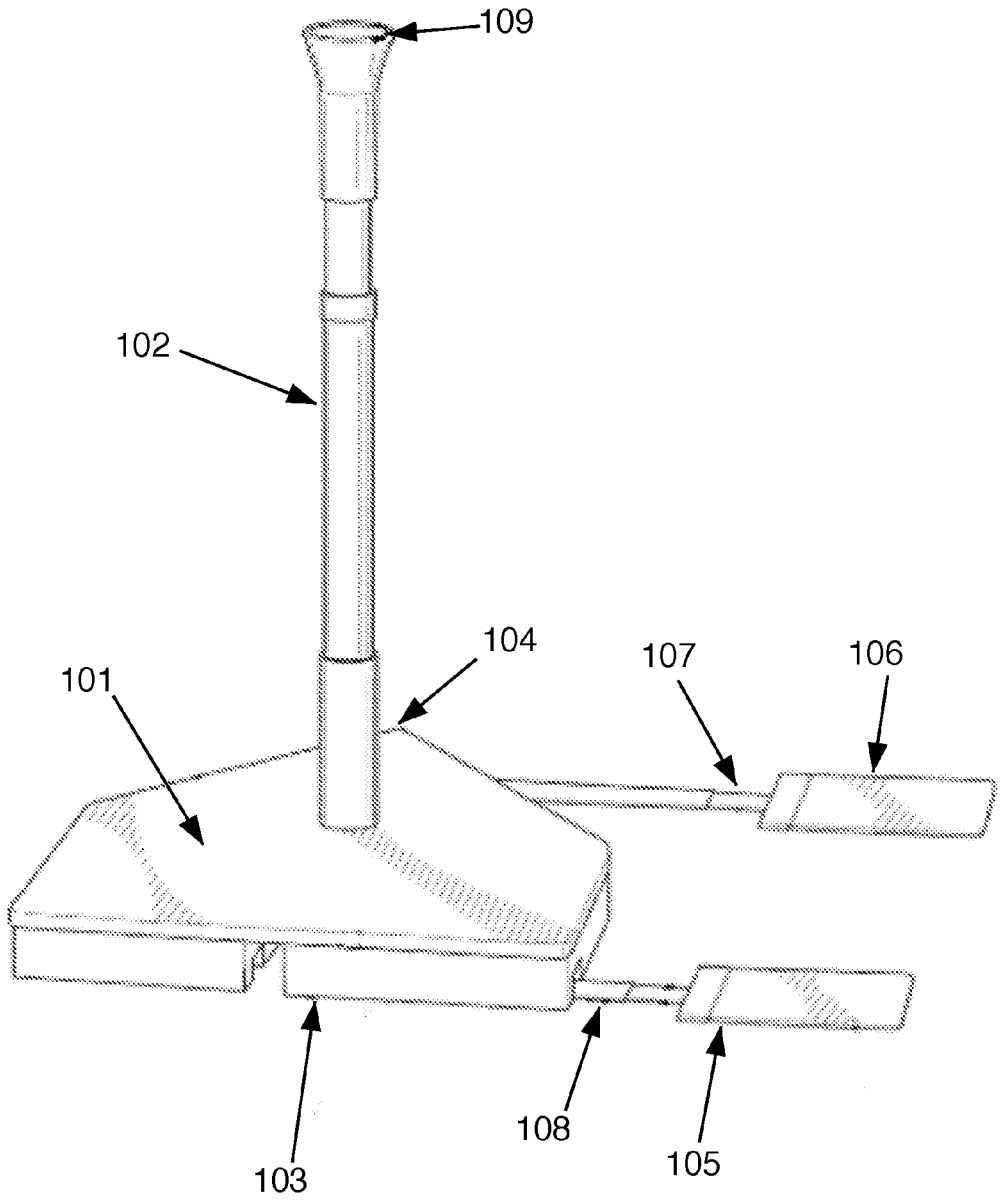
FIG. 1 is a perspective view of an embodiment of the subject matter of this application configured for use by a first hitter batting right-handed.

FIG. 1 shows the tee-ball apparatus which comprises a base (101) and a post (102). The base further comprises a front (103) and a back (104) and a right side (301) and a left side (302). In the drawings, the base has a pentagon "home base" shape in which a flat side of the pentagon faces the pitcher and the opposite apex of the pentagon points away from the pitcher. The tee-ball apparatus may be another shape. The base further comprises a front foot pad (105) a rear foot pad (106). The front and rear foot pads or movably attached to the base by a front and rear telescoping rods (108) and (107). In this drawing, the telescoping rods extend from the right side of the base. The post comprises a cup (109) in which a ball may sit during use.

Figure 2:
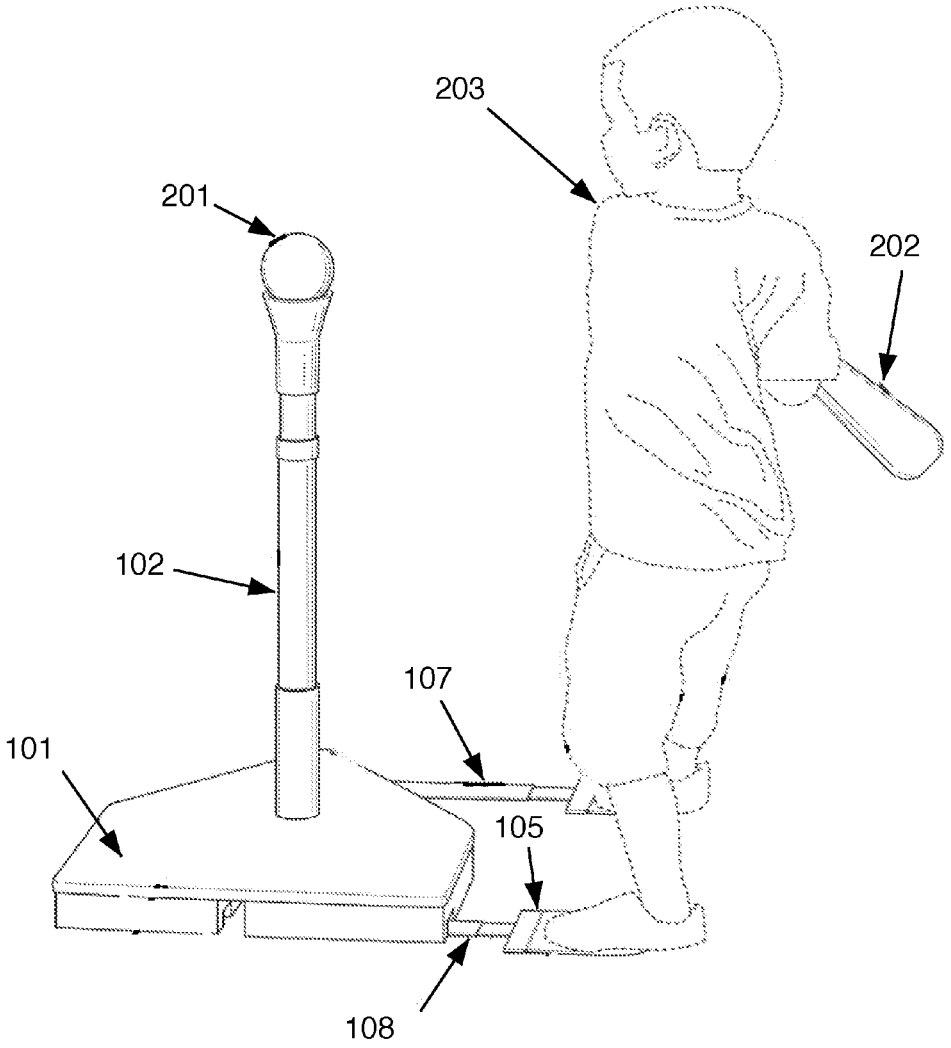
FIG. 2 is a perspective view of the subject matter of this application, with the first hitter's feet placed on the foot location mats.

FIG. 2 shows the tee-ball apparatus in use with a ball (201) in the ball cup (109). A child (203) stands with his left foot on the front foot pad (105) and his right foot on the back foot pad (106) is poised to swing the bat (202). This is the tee-ball apparatus in the "rightie" position for right handed hitters, in which the front (108) and rear (107) telescoping rods extend to the right side of the base (301).

Figure 3:
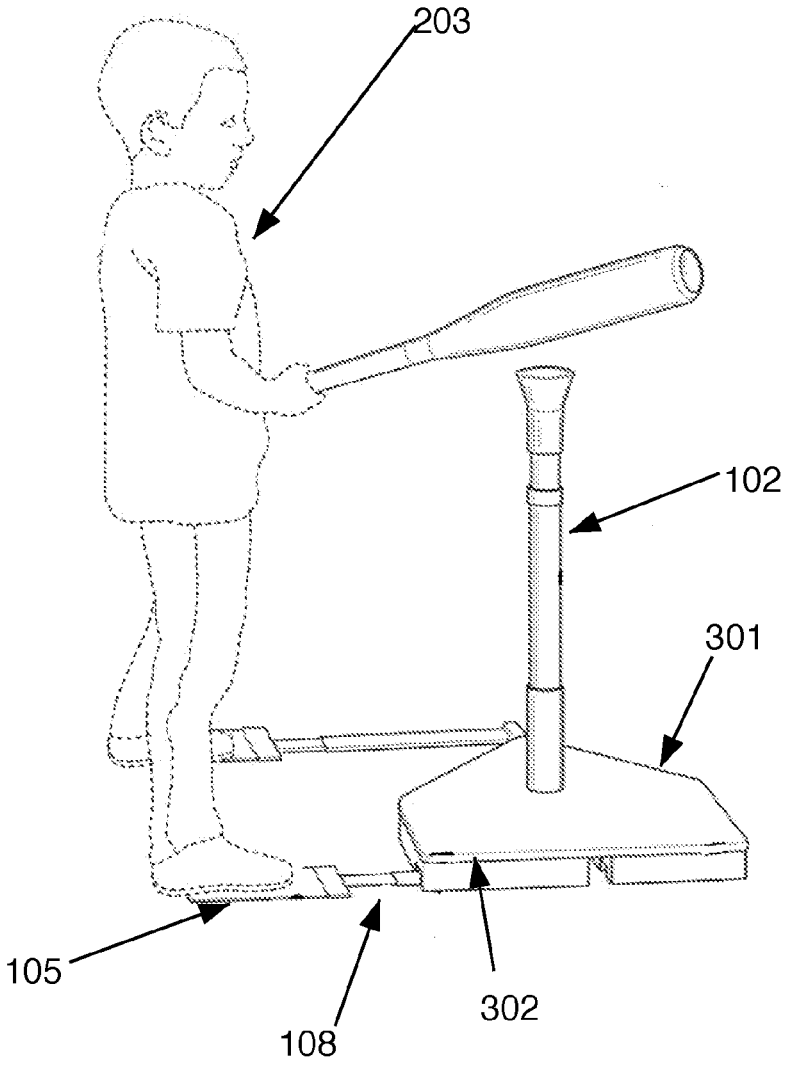
FIG. 3 is a perspective view of the subject matter of this application, adjusted for use by a second hitter, batting left-handed.

FIG. 3 shows the tee-ball apparatus with its telescoping rods extending from the left side of the base (302). This is the tee-ball apparatus' "leftie" position and is for use with left-handed hitters.

When in use, the telescoping rods of the tee ball apparatus are rotated into either the leftie or rightie position as the hitter requires and are extended or retracted as necessary so that the hitter's feet are in the proper position when standing on the foot pads. The hitter then places his feet on the pads and is ready to swing at the ball supported by the post of the tee-ball apparatus. In a most preferred embodiment, the post is capable of being extended or shortened so that one can adjust the height of the ball cup (109) for the height of the hitter. Further, in a most preferred embodiment, the base further comprises a connection means which can connect the post to the base. Further, in a preferred embodiment this connection means is a flexible connecting means that allows the post to be displaced if the hitter accidentally strikes the post, and then moved back into its upright position. In a most highly preferred embodiment, this flexible connector comprises a ball joint (701) and the post held in position by a plurality of springs (702) attached to the base and the post. In most favored embodiments, the post is capable of being removed from the connection means so that the post can be removed for practice with a pitcher while the tee-ball apparatus is still used as guides for the hitter's feet.

Figure 4:
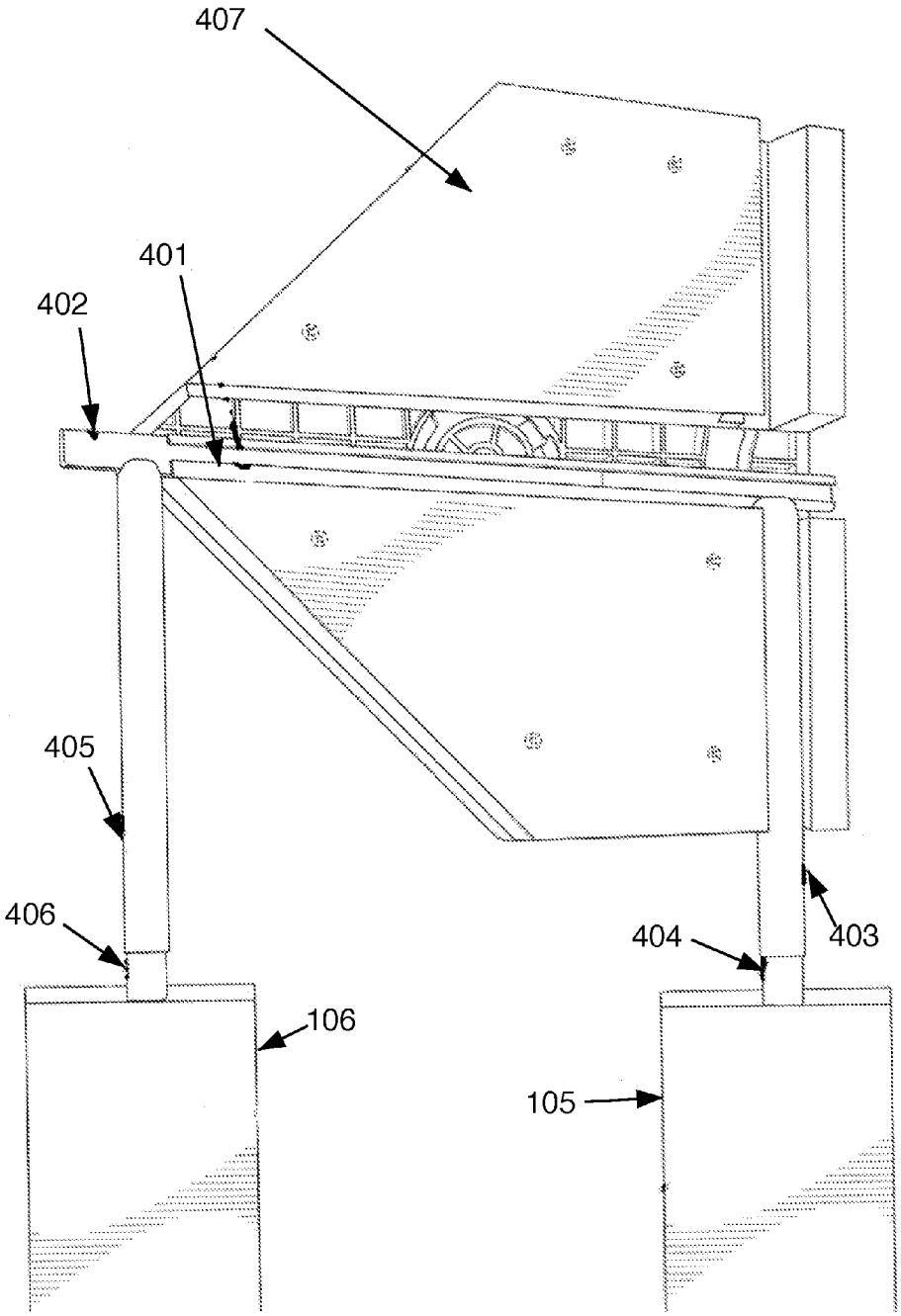
FIG. 4 is a lower perspective view of the subject matter of this application.

FIG. 4 is a view from the underside of the base of the tee-ball apparatus (407) when the tee-ball apparatus is in its rightie position. The base comprises a central hinge (401), a longitudinal axis parallel to the base's central hinge of the base and a transverse axis parallel to the telescoping rods (107 and 108). As used, "hinge" should be understood to include other devices and designs that allow movement such as a hinge does. For example, a leather band attached to the midline of the base is a "hinge" since it supports rotational movement around an axis as a hinge does. The base further comprises a vertical axis parallel to the post.

The telescoping rods are attached to the central hinge of the base and can pivot at least 180° along the central hinge. In this way the telescoping rods may be either extending towards the base's right side (301) or left side (302) when the base is set with its on the ground. The underside of the base further comprises a hinge receiving region (501) along its central longitudinal axis for receiving said hinge. Further, the central hinge may also be extendable along its longitudinal axis to increase the gap between the two telescoping rods. In a preferred embodiment, the hinge is extendable by a user pulling the portion of the hinge (402) located at the rear of the base away from the base. A user can therefore adjust the telescoping rods as necessary to place the foot pads (105, 106) in the proper position for the hitter's stance.

The front telescoping rod further comprises a sheath portion (403) and a piston portion (404). One may move the piston portion towards or away from the central hinge of the base along the transverse axis of the base as necessary to adjust the foot pads for the hitter. The rear telescoping rod further comprises a sheath portion (405) and a piston portion (406). This piston portion may also be extended away from the central hinge of the base or pushed towards it, along the transverse axis of the base as necessary to adjust for the hitter.

Figure 5:
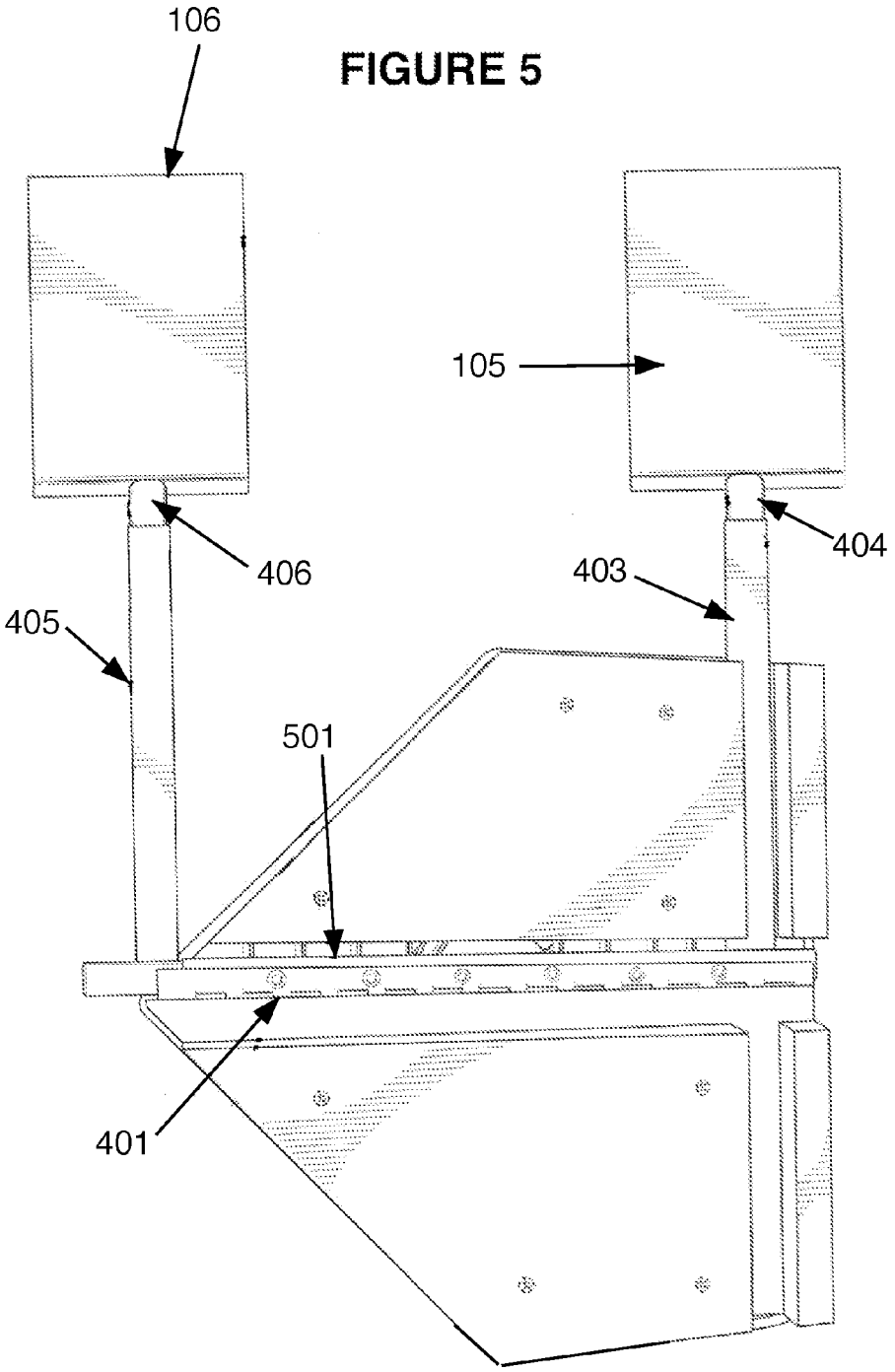
FIG. 5 is a lower perspective view of the subject matter of this application adjusted for use by a left-handed hitter.

FIG. 5 is a view from the underside of the tee-ball apparatus' base when the tee-ball apparatus is in its leftie position.

Figure 6:
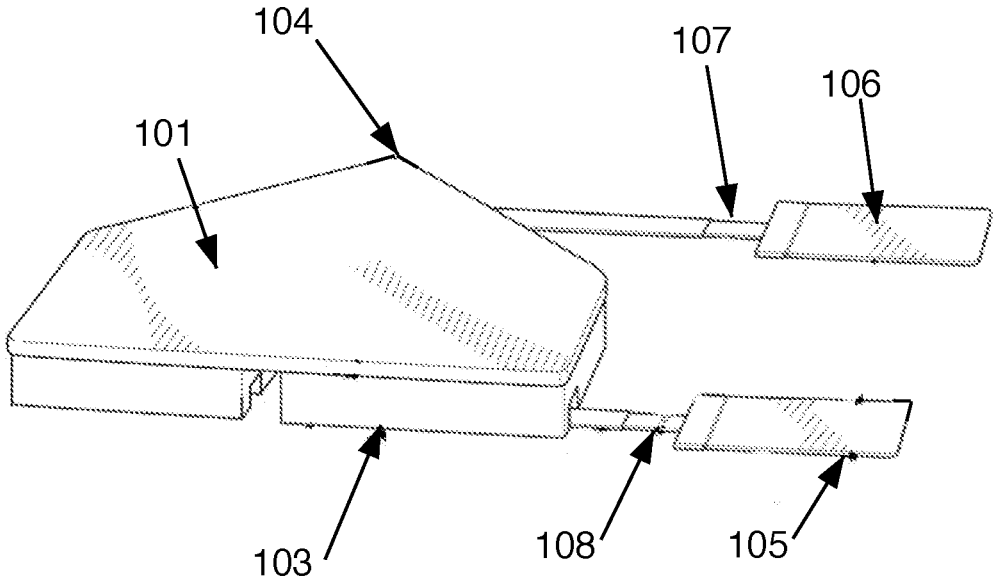
FIG. 6 is an illustration of the an embodiment of the subject matter of this application with the post removed.
Figure 7:
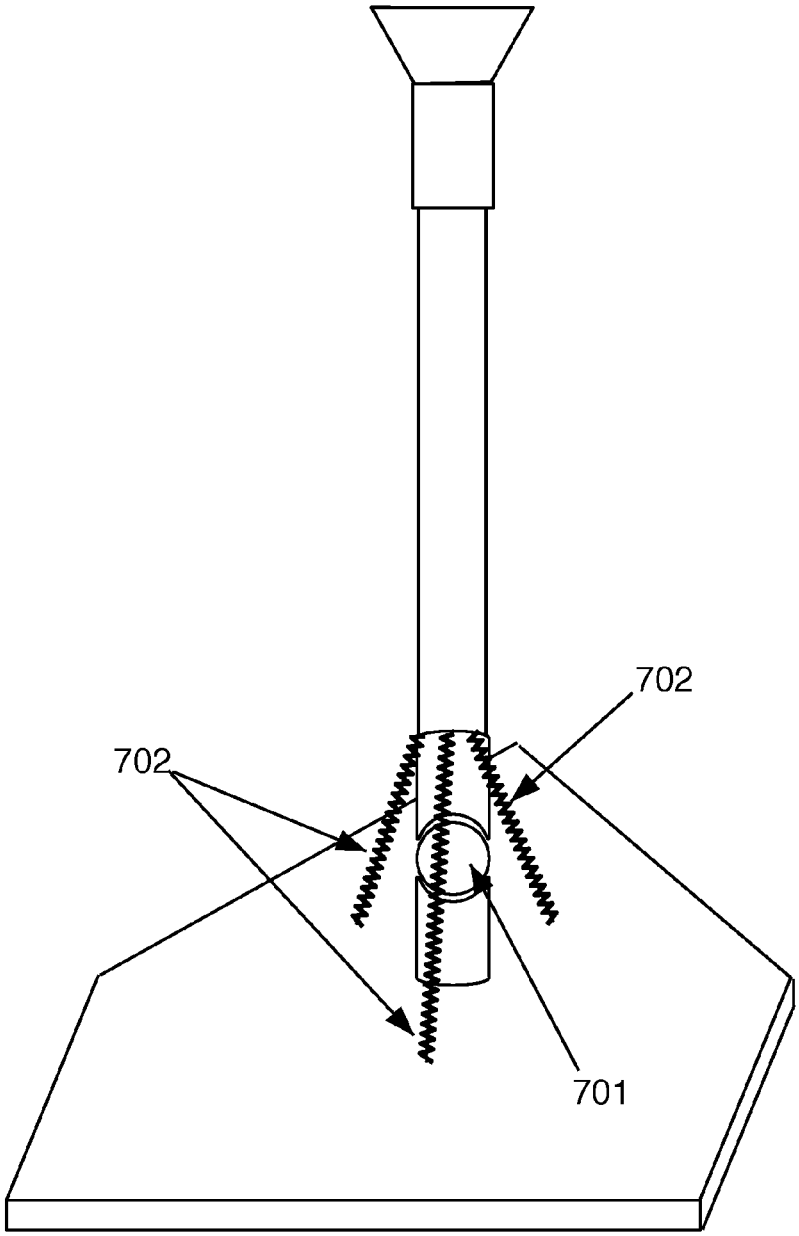
FIG. 7 is an illustration of an embodiment of the flexible connector.

FIG. 6 is a view of the tee-ball apparatus with the post removed. Removing the post provides a valuable intermediate training step between tee-ball and baseball or softball, because although the hitter would still stand on the foot pads to help train and maintain his ideal stance the hitter can practice hitting a pitched ball without the post interfering.

Once adjusted for a hitter, the foot pads of the tee-ball apparatus are held in place by friction against the ground and gravity. Even repeated swings by a first-time hitter will not significantly change the position of the foot pad so the hitter may practice as long as desired without a coach needing to interrupt and reposition the player. Adjusting the apparatus for each player may take only seconds regardless of whether the hitter bats right or left handed.

I claim:

1. A tee-ball apparatus comprising a base, a post, a front telescoping rod, a back telescoping rod, a front foot pad, and a back foot pad;

a) said base comprising a front side, a back side, a right side, a left side, a longitudinal axis which extends from the back side of the base to the front side of the base, a transverse axis, a vertical axis, a midline parallel to the longitudinal axis of the base, and a hinge located on the midline of the base;

i) said hinge capable of rotating at least 180°;

b) said post comprising a longitudinal axis, a bottom terminus, and a top terminus;

i) said bottom terminus connected to an upper surface of the base; and ii) said top terminus comprising a ball holder having a concave surface;

c) said front telescoping rod comprising a longitudinal axis parallel to the transverse axis of the base, a first end, and a second end;

a) said first end connected to the front foot pad and, b) said second end connected to the hinge;

d) said back telescoping rod comprising a longitudinal axis parallel to the transverse axis of the base, a first end, and a second end;

a) said first end connected to the back foot pad and, b) said second end connected to the hinge.

2. The tee-ball apparatus of claim 1 wherein the bottom terminus of the post is connected to the base by a flexible connector.

3. The tee-ball apparatus of claim 1 wherein the post is removably attached to the base.

* * * * *